US007421965B2

(12) United States Patent
Wakabayashi et al.

(10) Patent No.: US 7,421,965 B2
(45) Date of Patent: Sep. 9, 2008

(54) FLEXIBLE BUOY

(75) Inventors: Masashi Wakabayashi, Hiratsuka (JP); Michito Kaneko, Hiratsuka (JP)

(73) Assignee: The Yokohama Rubber Co., Ltd., Tokyo (JP)

( * ) Notice: Subject to any disclaimer, the term of this patent is extended or adjusted under 35 U.S.C. 154(b) by 0 days.

(21) Appl. No.: 11/578,204

(22) PCT Filed: Apr. 28, 2005

(86) PCT No.: PCT/JP2005/008119

§ 371 (c)(1),
(2), (4) Date: Oct. 11, 2006

(87) PCT Pub. No.: WO2005/105564

PCT Pub. Date: Nov. 10, 2005

(65) Prior Publication Data

US 2007/0275614 A1 Nov. 29, 2007

(30) Foreign Application Priority Data

Apr. 30, 2004 (JP) ..... 2004-135346

(51) Int. Cl.
*B63B 59/02* (2006.01)

(52) U.S. Cl. ..... 114/219

(58) Field of Classification Search ..... 441/1, 441/23; 114/219
See application file for complete search history.

(56) References Cited

U.S. PATENT DOCUMENTS

| | | | | | |
|---|---|---|---|---|---|
| 3,063,400 | A | * | 11/1962 | Yamaguchi et al. | 114/219 |
| 4,197,233 | A | * | 4/1980 | Marshall | 523/122 |
| 4,273,065 | A | * | 6/1981 | Lindsay et al. | 114/219 |
| 4,296,705 | A | * | 10/1981 | Uruta et al. | 114/219 |
| 4,924,796 | A | * | 5/1990 | Duffy | 114/219 |

FOREIGN PATENT DOCUMENTS

| | | |
|---|---|---|
| JP | 49-17700 | 2/1974 |
| JP | 58753/1986 | 4/1986 |
| JP | 62-137295 | 6/1987 |
| JP | 24097/1988 | 2/1988 |
| JP | 3-26345 | 6/1991 |
| JP | 11-342894 | 12/1999 |
| JP | 2004-0123086 | 4/2004 |

* cited by examiner

*Primary Examiner*—Stephen Avila
(74) *Attorney, Agent, or Firm*—Greer, Burns & Crain, Ltd.

(57) ABSTRACT

Provided is a flexible buoy lightweight, excellent in workability, and excellent in durability preventing the buoy from being damaged by contact and collision with another object. An airtight hollow structure (2) is formed of a flexible membrane made of rubber or resin, in which a reinforcement layer (C) is buried. A flange opening (4) having a gas inlet is fixed to at least one position of the hollow structure (2). Buoyancy thereof can be controlled by using an internal pressure of a gas injected in the hollow structure (2).

11 Claims, 4 Drawing Sheets

FLEXIBLE BUOY

TECHNICAL FIELD

The present invention relates to a flexible buoy. More specifically, the present invention relates to a flexible buoy configured to enhance workability of placing and removing mooring rope and the like of a rig in water.

BACKGROUND ART

In general, a steel buoy is used as a mooring buoy which is used for placing and removing mooring rope of an oil drilling rig or the like in an offshore area (for example, refer to Patent Document 1). However, because the oil drilling rig is moved with a change of places for drilling, at every time of the movement, construction for placing and removing an anchor, mooring rope and the mooring buoy is repeatedly carried out. Additionally, at every time of the movement, the above steel buoys are piled on a working boat and the buoys are unloaded at the next place for drilling.

However, because the steel buoy has stiffness while being a heavy load, there have been a lot of problems that the working boat, and an object on the working boat are damaged when the steal buoy is in contact with them and that the buoys occupy a space on the working boat.

Additionally, because the steel buoy does not have shock-absorbing properties, it have often happed that, when the steel buoy collides with another object, the buoy itself becomes recessed and damaged.

Moreover, when the steel buoy is used in a water zone with a depth deeper than a specified depth, by mistake, the buoy sometimes crushes due to a hydraulic pressure. Once the steel buoy has thus crushed, collection of the steel buoy becomes difficult. In addition, even if the steel buoy is collected, it is impossible to reuse the steel buoy because an original form thereof cannot be restored.

Furthermore, because steel which is material for the steel buoy is corrosive, while the buoy is being placed in the water, the buoy should be disembarked at regular intervals to be treated with maintenance for corrosion prevention, or to be replaced in some situations.

[Patent Document 1] Japanese patent application Kokai publication No. Hei 10-310095

DISCLOSURE OF THE INVENTION

An object of the present invention is to resolve the above described conventional problems, and to provide a flexible buoy which is lightweight and excellent in workability, and which has excellent durability preventing the buoy from being damaged by contact and collision with another object.

The flexible buoy for achieving the above object is characterized in that an airtight hollow structure is formed of a flexible membrane made of rubber or resin, in which a reinforcement layer is buried, that a flange opening includes a gas inlet fixed to at least one position of the hollow structure, and that buoyancy thereof is controllable by using an internal pressure of a gas injected in the hollow structure.

With the above mentioned configuration, the flexible buoy of the present invention has the following excellent effects that:

(1) Since the buoy is lightweight and foldable in a deflated state, it is made possible to obtain excellent workability in constructions for placing and removing on the water, to easily store the buoys on land or on a boat, and to easily secure a storage space;

(2) Since the buoy is flexible, when the buoy is collided with another object on the water, the buoy will not be recessed or damaged, and additionally will not damage a counterpart object, such as a boat, colliding with the buoy;

(3) Since the buoyancy thereof is controllable by adjusting the internal pressure, the buoy is capable of maintaining the desired buoyancy while avoiding being crushed due to an external pressure even in deep water;

(4) Even in the case where the buoy is drawn into the water with a depth deeper than a predetermined one and becomes squashed, it is possible to restore the original form thereof without being permanently deformed; and (5) The buoy is characterized in that it is difficult to be corroded by sea water and the like.

The flexible buoy of the present invention can be used in a manner that one of the abovementioned flexible buoys is, or the plural flexible buoys coupled to one another are, hung down in the water with a longitudinal direction of the hollow structures of the flexible buoys being set in the vertical direction, and that a heavy load is connected to an lower end portion of the single one or the plural ones of the flexible buoys.

BEST MODES FOR CARRYING OUT THE INVENTION

Hereinbelow, embodiments of the present invention will be described with reference to the accompanying drawings.

Figure 1:
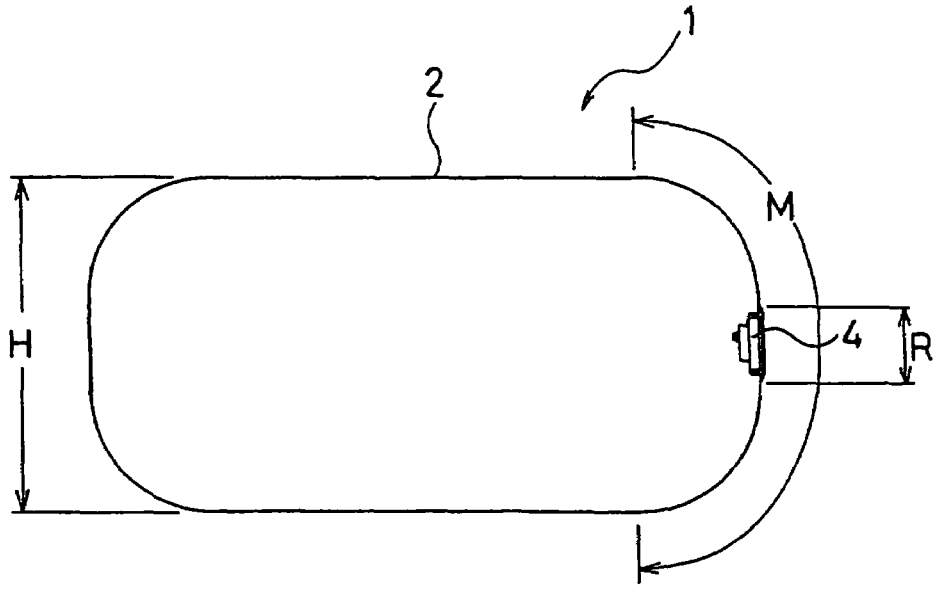
FIG. 1 is a cross-sectional view showing one example of a flexible buoy of the present invention.

FIG. 1 is an explanatory diagram showing a cross-sectional profile of one embodiment of a flexible buoy of the present invention.

In FIG. 1, a flexible buoy 1 is constituted of a flexible membrane which is made of rubber or resin, which includes a reinforcement layer C (refer to FIG. 2) buried therein. The flexible buoy 1 is formed as an airtight hollow structure 2 to which a flange opening 4 having a gas inlet is provided. Since the hollow structure 2 is constituted of the flexible membrane made of the rubber or the resin, the hollow structure 2 is characterized by being lightweight, and by being foldable in a state that it is deflated.

This flexible buoy 1 is used in the water or on the water. The internal pressure of the highly airtight hollow structure 2 can be controlled by having a gas, such as air, injected into or discharged from the hollow structure 2 through the inlet. Accordingly, the buoyancy of the flexible buoy 1 in the water can be controlled.

FIG. 1 illustrates a case where the hollow structure 2 is formed into a cylindrical shape having hemispheric shapes in both end portions in the longitudinal direction. However, a shape of the hollow structure 2 is not limited to this, and may be an angled cylinder or may be a hollow sphere.

Figure 2:
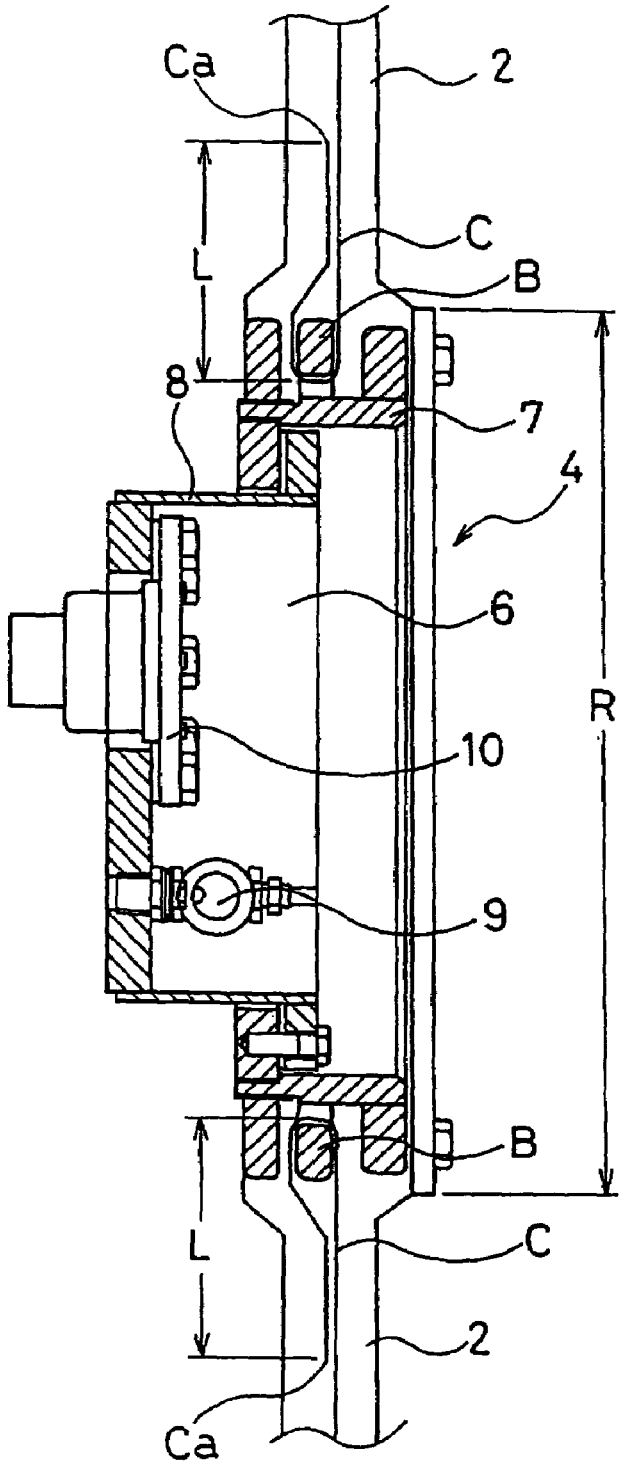
FIG. 2 is a longitudinal cross-sectional view of a part near a flange opening of the flexible buoy of FIG. 1.

As shown in FIG. 2, a fixture 8 is fixed to the flange opening 4 through a bracket 7. At least one kind of valves such as a gas inlet 9 and a safety valve 10 are fixed to the fixture 8. Additionally, the flange opening 4 is fixed to the hollow structure 2 by wrapping an end portion Ca of the reinforcement layer C around a metal ring B provided in an outer rim of the bracket 7 in a manhole 6.

The reinforcement layer C is constituted of a large number of arrayed reinforcing cords, or fabric cloth. The reinforcement layer C is buried in a flexible member, such as rubber or resin, constituting the flexible membrane, thereby functioning so as to enable the hollow structure 2 to endure a pressure of the gas injected into the inside thereof. Although kinds of the reinforcing cords and the fabric cloth are not particularly limited, it is preferable that the reinforcing cords and the fabric cloth be constituted of an organic fiber material such as nylon or polyester. Thereby, flexibility of the hollow structure 2 is secured, whereby it becomes easier to fold the hollow structure 2 in a state where air in the inside is discharged.

The flexible membrane is constituted of rubber, resin or the like, which are flexible. It is preferable to use, as these rubber and resin, a material excellent in antifouling properties which is, for example, a rubber composition containing an antifouling component such as Japanese horseradish extracts or an isothiazolone derivative, resin made of polyurethane or polyethylene with small surface friction resistance, or silicon-based or fluorine-based resin. This makes it difficult that sea water corrodes the hollow structure 2, and also prevents adhesion of marine organisms such as a shellfish to the hollow structure 2. Thus, by avoiding change in the buoyancy of the flexible buoy 1 due to the adhesion of marine organisms, it is possible to secure more stability of the buoyancy thereof in the water, and simultaneously to reduce work for removing the marine organisms.

With the above described configuration, the flexible buoy 1 of the present invention has the following excellent effects that: (1) since the buoy is lightweight and foldable in a deflated state, it is made possible to obtain excellent workability in constructions for placing and removing on the water, to easily store the buoys on land or on a boat, and to easily secure a storage space; (2) since the buoy is flexible, when the buoy is collided with another object on the water, it does not be recessed or damaged and additionally does not damage a counterpart object, such as a boat, collided with the buoy; (3) since the buoyancy thereof is controllable by adjusting the internal pressure, the buoy is capable of maintaining the desired buoyancy while avoiding crush due to an external pressure even in the deep water; (4) even in the case where the buoy is drawn into the water with deeper than a predetermined depth and thereby becomes squashed, it is possible to restore the original form thereof without being permanently deformed; and (5) it is difficult to be corroded by sea water and the like, and unlikely to suffer from damage caused by marine organisms and the like.

In the present invention, as one embodiment of the hollow structure 2, it is preferable that the reinforcement layer C is constituted of a plurality of reinforcing cords arranged in the longitudinal direction of the hollow structure 2 and a plurality of reinforcing cords arranged in the circumferential direction thereof. Additionally, tensile stiffness of the reinforcement layer C in the circumferential direction may be adjusted to be not less than twice as high as tensile stiffness thereof in the longitudinal direction preferably, and more preferably, not less than twice and not more than four times as high as the tensile stiffness in the longitudinal direction. Thereby, the flexible membrane constituting the hollow structure 2 can be made durable against higher pressure even when the thickness thereof is made thinner. Accordingly, the hollow structure 2 has advantages such as easiness of folding work thereof in a deflated state and easiness of use thereof in deep water ocean.

In addition, as another embodiment, in order to enhance flexibility of the hollow structure 2, and to further enhance folding workability thereof in a deflated state, it is preferable that the reinforcement layer C be constituted of a plurality of reinforcing cords arranged so as to intersect with the longitudinal direction of the hollow structure 2, obliquely; and a plurality of reinforcing cords arranged so as to intersect with the longitudinal direction thereof, obliquely in the reverse direction of the above mentioned plurality of reinforcing codes. To be more precise, it is preferable that the reinforcement layer C be constituted of a plurality of plies each having the reinforcing cords arranged parallel to one another at a predetermined angle with the longitudinal direction of the hollow structure 2 and that the plurality of plies be superimposed in a manner that the reinforcing cords of the adjacent plies intersect with each other obliquely at the same angle with the longitudinal direction of the hollow structure 2, but respectively in the reverse direction. In this case, an intersecting angle between the cords of the respective adjacent plies may be set preferably at 100 to 120 degrees, more preferably at 105 to 115 degrees, and particularly preferably at 109.5 degree. By thus setting the intersection angle, the hollow structure 2 can constantly maintain a stable shape regardless of a magnitude of the internal pressure, besides the above mentioned effects.

In the embodiment in FIG. 1, it is preferable that the flange opening 4 having the gas inlet be provided in at least one of both longitudinal end portions of the hollow structure 2. It is possible to fix the flange opening 4 to one of both longitudinal end portions of the hollow structure 2, and also to provide the flange openings 4 in both end portions thereof Considering that the flexible buoy 1 is made lightweight to be handled easily, it is more advantageous to provide the flange opening 4 in one end portion. In the case where the flange openings 4 are fixed to both end portions, the inlet, the safety valve and the like can be allocated to any one of both of the flange openings.

Additionally, the flange opening 4 fixed to the end portion of the hollow structure 2 has a disc shape, and it is preferable that the external diameter R of the flange opening 4 be set at 10 to 50% of the external diameter H of the hollow structure 2. In the case where the external diameter R exceeds 50% of the external diameter H, workability in folding is reduced, and additionally, the hollow structure 2 becomes more likely to be damaged when it collides with another object. In the case where it is less than 10%, the inlet, the safety valve and the like becomes more difficult to be attached, and moreover, operability of the inlet and the like tends to be reduced. Thus, both of the cases are not preferable.

As shown in FIG. 2, in order to enhance airtightness and pressure resistance of the hollow structure 2, the reinforcement layer C and the hollow structure 2 may be attached to each other by folding back the end portion Ca of the reinforcement layer C around the metal ring B provided in the circumference of the flange opening 4, and thus holding the reinforcement layer C. Here, a folded-back length L of the reinforcement layer C is set at preferably not more than 50%, and more preferably at a range from not less than 5% to not more than 50%, of a length M (refer to FIG. 1) of the hemispheric shape in the longitudinal end portion of the hollow structure 2. In the case where the folded-back length L exceeds 50% of the length M, hardness of the hollow structure 2 in a hemispheric portion of the longitudinal end portion increases, whereby the hollow structure 2 becomes difficult to be folded. In the case where it is less than 5%, attachment strength between the reinforcement layer C and the hollow structure 2 might be insufficient. Thus, both of the cases are not preferable.

Figure 3:
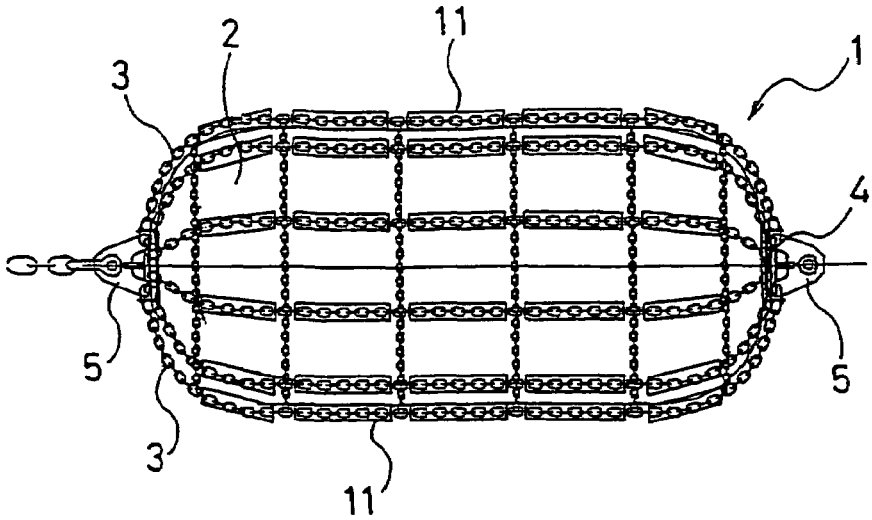
FIG. 3 is a side view showing a state where the outside of the flexible buoy of FIG. 1 is armored with a coupling structure.

It is preferable that the flexible buoy 1 constituted as described above be armored with the coupling structure 3 formed of chains around the hollow structure 2, prior to use thereof, as shown in FIG. 3. Furthermore, in both end portions of the coupling structure 3, that is, in positions corresponding to the longitudinal end portions of the coupling structure 3, hanging attachments 5 and 5 are provided. The coupling structure 3 has a function for protecting the hollow structure 2 against damage due to collision thereof with an object from the outside, and also a function for hanging a heavy load while externally wrapping the hollow structure 2 at the time of use thereof in water.

In the present invention, it is preferable that each of chains 3*a* (refer to FIG. 4) constituting the coupling structure 3 is covered with a tubular body 11 made of flexible material. Thereby, the chains 3*a* constituting the coupling structure 3 are not brought into contact directly with the hollow structure 2, whereby preventing the hollow structure 2 from being damaged due to friction, and also preventing the chains 3*a* from damaging a working boat or an object on the working boat.

It is preferable to use, as the flexible material constituting the tubular body 11, a material excellent in antifouling properties selected from a group consisting of, for example, a rubber composition containing an antifouling component such as Japanese horseradish extracts or an isothiazolone derivative, resin made of polyurethane or polyethylene with small surface friction resistance, and silicon-based or fluorine-based resin. Thereby, marine organisms, such as a shellfish, are unlikely to adhere to the tubular body 11, whereby a change in buoyancy caused by the adhesion of the marine organisms is avoided, and furthermore, work for removing marine organisms becomes almost unnecessary.

Figure 4:
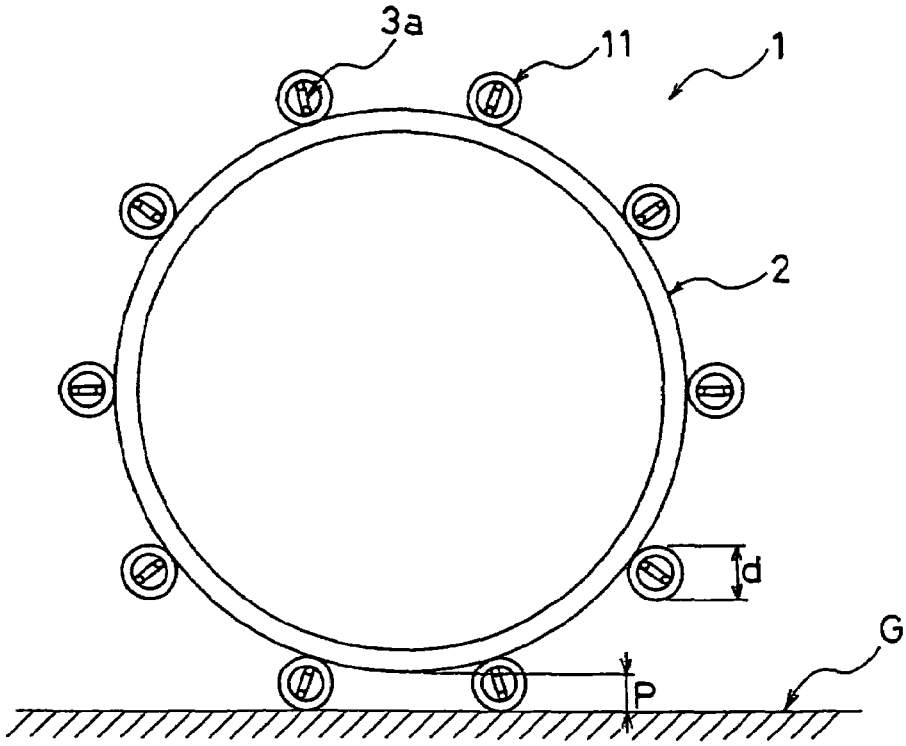
FIG. 4 is a cross-sectional view of the flexible buoy of FIG. 3 orthogonal to the longitudinal direction in a state where the flexible buoy is placed on land with the longitudinal direction thereof made horizontal.

In the present invention, when the flexible buoy 1 is left at rest, as shown in FIG. 4, on land in a state where the longitudinal direction of the hollow structure 2 is set horizontally, it is preferable that a clearance P is formed between the lowest surface of the hollow structure 2 and the ground surface G. The clearance P is adjusted by appropriately setting an external diameter d of the chain 3*a* and the tubular body 11. This clearance P may be set preferably at not less than 50 mm, and more preferably at a range from not less than 50 mm to not more than 100 mm. This makes it possible to prevent the hollow structure 2 from being in contact directly with a deck of a working boat, as well as to prevent the hollow structure 2 from being damaged by various objects on the deck when the flexible buoy 1 is pulled up onto the working boat.

In the present invention, in the case where the flexible buoy 1 is placed on the water, the hollow structure 2 including the reinforcement layer and the flexible membrane, which are durable against a pressure in accordance with a water depth is prepared, and the hollow structure 2 is inflated to adjust the internal pressure by injecting a gas such as air through the inlet 9 of the flange opening 4 fixed thereto. Subsequently, after armoring the circumference of each of the hollow structures 2 with the coupling structure 3, a single flexible buoy 1 is used, or a plurality of flexible buoys 1 are used in a coupled manner (refer to FIG. 5), by being hung down in the water.

Figure 5:
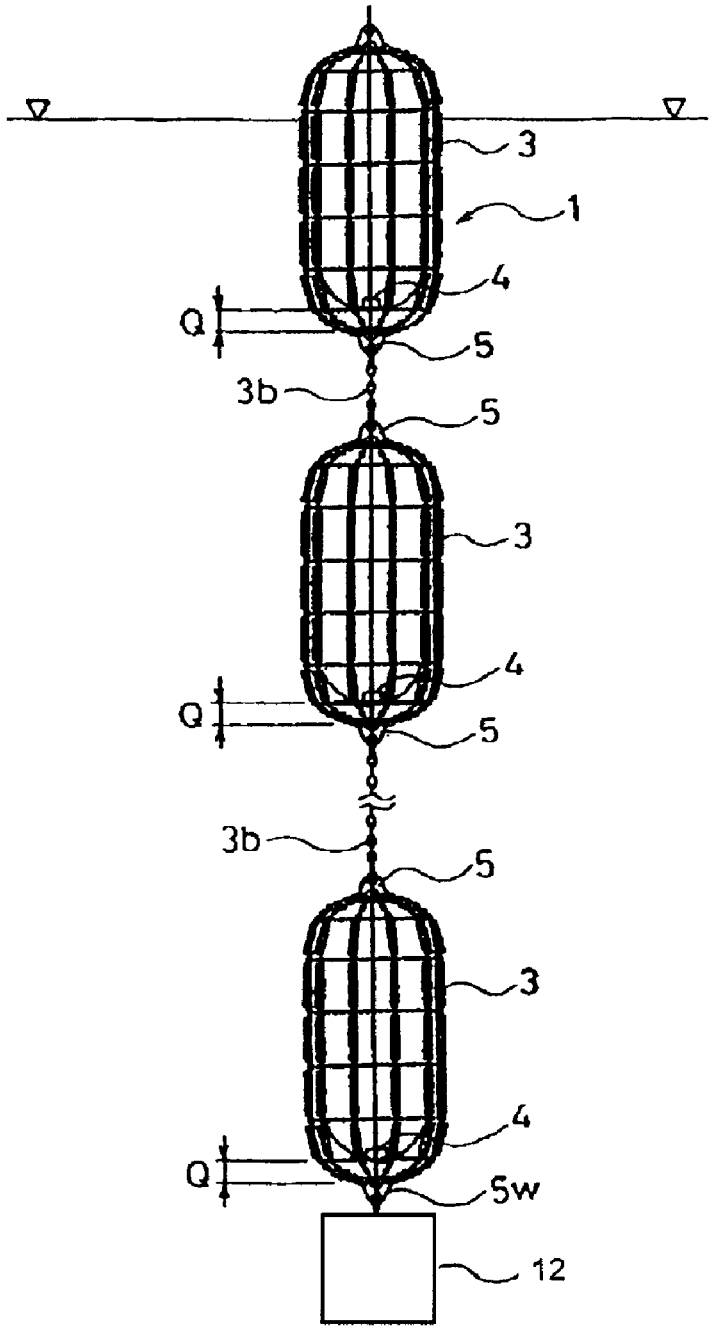
FIG. 5 is an explanatory diagram showing a state where the flexible buoys of FIG. 3 are placed in the water.

In this case, when the flexible buoy 1 is hung down in the water with the longitudinal direction of the hollow structure 2 being set along the vertical direction, it is preferable to adjust so as to form a clearance Q between a lowest end portion of the hollow structure 2 and the lowest end portion of the coupling structure 3. The clearance Q can be adjusted by appropriately setting the longitudinal length of the coupling structure 3. This clearance Q may be adjusted preferably at not less than 200 mm, and more preferably at a range from not less than 200 mm to not more than 2000 mm. Additionally, when the flexible buoy 1 is hung down in the water with the longitudinal direction of the hollow structure 2 being set along the vertical direction, as shown in FIG. 5, it may be hung down in a way that the flange opening 4 comes to the underside.

By thus forming the clearance Q, the flange opening 4 and the inlet which are fixed to the underside of the flexible buoy 1 are not brought in contact directly with the coupling structure 3. Therefore, damage to the flange opening 4 and the inlet can be prevented even when the flexible buoy 1 is strongly shaken up and down due to waves or the like.

In a case of using the flexible buoy of the present invention, as described above, it is preferable to hang down the flexible buoys of the number appropriate to a water depth, with the longitudinal direction of the hollow structures 2 being set along the vertical direction, and to use the flexible buoys in a state that a heavy load 12 is connected to the lowest end portion of the coupling structures 3. Thereby, the flexible buoy can play a role of reducing a weight of the heavy load 12, and a role of making the heavy load float on the water or in the water. In this case, when plural flexible buoys 1 are coupled together and hung down in the water, as shown in FIG. 5, it is preferable that the hanging attachments 5 provided to the end portions of the respective coupling structures 3 be coupled to one another by means of rope and the chains 3*b*, and that the heavy load 12 be connected to a hanging attachment 5*w* provided on the bottommost side of the plural flexible buoys 1.

By thus hanging down the flexible buoys in the water and by coupling a heavy load to the lowest end thereof, the flexible buoys 1 come to rest in a stable state, whereby no unnecessary tensile force acts upon the rope or the chains 3*b*. Additionally, in the case where plural flexible buoys 1 are used in the coupled state, more buoyancy can be obtained, and therefore, a heavier heavy load can be hung. Although the heavy load in the water is not particularly limited in the present invention, mooring rope, rope connected to an underwater installation and the like are preferably listed as the heavy load.

As described above, although the case where the hollow structure 2 is formed into a substantially cylindrical shape with both end portions being made hemispheric has been illustrated in the embodiments shown in the drawings, a shape of the hollow structure 2 is not particularly limited and may be an angled cylinder, or may be a hollow sphere.

What is claimed is:

1. A flexible mooring buoy comprising:

an airtight hollow structure formed of a flexible membrane which is made of any of rubber and resin, which includes a reinforcement layer buried therein; and a flange opening including a gas inlet which is fixed to at least one place of the hollow structure, wherein buoyancy is controlled by using an internal pressure of a gas injected in the hollow structure, wherein an outside of the hollow structure is armored with a coupling structure formed of chains, wherein hanging attachments are fixed to positions of the coupling structure, the position corresponding respectively to longitudinal end portions of the hollow structure, and wherein a circumference of each of the chains constituting the coupling structure is covered with a tubular body made of flexible material, wherein the reinforcement layer is constituted of any one of a large number of arrayed reinforcing cords, and fabric cloth, wherein the hollow structure is formed into a cylindrical shape which has hemispherical shapes on both longitudinal end portions thereof, wherein the reinforcement layer is formed of a plurality of reinforcing cords arranged in the longitudinal direction of the hollow structure and a plurality of reinforcing cords arranged in the circumferential direction thereof, wherein tensile stiffness of the reinforcement layer in the circumferential direction is not less than twice as high as tensile stiffness thereof in the longitudinal direction, wherein a clearance P is formed between the lowest surface of the hollow structure and a surface of land, when the flexible mooring buoy is left at rest on the land in a state that a longitudinal direction of the hollow structure is horizontal, wherein the clearance P is not less than 50 mm to not more than 100 mm, and wherein tensile stiffness of the reinforcement layer in the circumferential direction is not less than twice and not more than four times as high as the tensile stiffness thereof in the longitudinal direction.

2. The flexible mooring buoy according to claim 1, wherein the reinforcement layer is formed of a plurality of reinforcing cords arranged so as to intersect with the longitudinal direction of the hollow structure obliquely, and a plurality of reinforcing cords arranged in the reverse oblique direction of the longitudinal direction thereof.

3. The flexible mooring buoy according to claim 1, wherein the flange opening is provided at least to one of both longitudinal end portions of the hollow structure.

4. The flexible mooring buoy according to claim 3, wherein an external diameter of the flange opening is set at 10 to 50% of an external diameter of the hollow structure.

5. The flexible mooring buoy according to claim 3, wherein: a metal ring is provided in a circumference of the flange opening; an end portion of the reinforcement layer is folded back around the metal ring, and is held by the metal ring; and a folded-back length of the reinforcement layer is set at not more than 50% of a length of a hemispheric shape in the longitudinal end portion of the hollow structure.

6. The flexible mooring buoy according to claim 1, wherein the flexible membrane is constituted of antifouling material.

7. The flexible mooring buoy according to claim 1, wherein the tubular body is constituted of antifouling material.

8. The flexible mooring buoy according to claim 1, wherein, a clearance Q is formed between the lowest end portion of the hollow structure and the lowest end portion of the coupling structure, when the flexible mooring buoy is hung down in the water with a longitudinal direction of the hollow structure being set in a vertical direction.

9. The flexible mooring buoy according to claim 8, wherein the clearance Q is not less than 200 mm.

10. A method of using the flexible mooring buoy according to any one of claims 1, 2-6, 7, 8 and 9, wherein the flexible mooring buoy is hung down in the water with a longitudinal direction of the hollow structure being set in the vertical direction, and a heavy load is connected to the lowest end portion thereof.

11. The method of using the flexible mooring buoy according to claim 10, wherein a plurality of flexible mooring buoys are in series coupled together, and hung down in the water.

* * * * *